US010796644B2

(12) United States Patent
Du et al.

(10) Patent No.: US 10,796,644 B2
(45) Date of Patent: Oct. 6, 2020

(54) METHOD OF DRIVING DYNAMIC BACKLIGHT AND DISPLAY DEVICE

(71) Applicant: Qingdao Hisense Electronics Co., Ltd, Qingdao (CN)

(72) Inventors: Qiang Du, Qingdao (CN); Yuxin Zhang, Qingdao (CN); Tingke Cai, Qingdao (CN)

(73) Assignees: HISENSE VISUAL TECHNOLOGY CO., LTD., Qingdao (CN); HISENSE INTERNATIONAL CO., LTD., Qingdao (CN); HISENSE USA CORPORATION, Suwanee, GA (US)

( * ) Notice: Subject to any disclaimer, the term of this patent is extended or adjusted under 35 U.S.C. 154(b) by 176 days.

(21) Appl. No.: 16/026,761

(22) Filed: Jul. 3, 2018

(65) Prior Publication Data

US 2018/0315379 A1 Nov. 1, 2018

(30) Foreign Application Priority Data

Jul. 27, 2017 (CN) ..... 2017 1 0623557

(51) Int. Cl.
*G09G 3/34* (2006.01)

(52) U.S. Cl.
CPC ..... *G09G 3/3406* (2013.01); *G09G 2320/064* (2013.01); *G09G 2320/0626* (2013.01); *G09G 2340/0435* (2013.01)

(58) Field of Classification Search
CPC ..... G09G 3/3406; G09G 2340/0435; G09G 2320/064; G09G 2320/0626; H04N 5/04
See application file for complete search history.

(56) References Cited

U.S. PATENT DOCUMENTS

2007/0211014 A1* 9/2007 Kim ..... G09G 3/3406 345/102
2010/0020004 A1* 1/2010 Smith ..... G09G 3/342 345/102

(Continued)

FOREIGN PATENT DOCUMENTS

CN 1811536 A 8/2006
CN 102890917 A 1/2013

(Continued)

OTHER PUBLICATIONS

International Search Report from PCT Application No. PCT/CN2018/093847 dated Sep. 5, 2018 (5 pages).

(Continued)

*Primary Examiner* — Carolyn R Edwards
(74) *Attorney, Agent, or Firm* — Harness, Dickey & Pierce, P.L.C.

(57) ABSTRACT

The embodiments of the disclosure discloses a method of driving a dynamic backlight and a display device. In this method, a vertical synchronization signal corresponding to an input image signal is received; a first level signal and a second level signal are outputted alternately in response to a change edge of the vertical synchronization signal, where the total duration of the first level signal and the second level signal is 1/m of the duration between the change edge and a first change edge before the change edge, wherein the change edge and the first change edge before the change edge are change edges of a same changing direction; m is a positive integer; and the drive chip receives the first level signal and the second level signal and generates a PWM signal according to the first level signal and the second level signal.

4 Claims, 7 Drawing Sheets

(56) References Cited

U.S. PATENT DOCUMENTS

| | | | | |
|---|---|---|---|---|
| 2011/0175935 | A1 | 7/2011 | S et al. | |
| 2012/0169801 | A1* | 7/2012 | Lee | G09G 3/3406 345/691 |
| 2013/0021386 | A1* | 1/2013 | Min | G09G 3/3413 345/690 |
| 2013/0141479 | A1* | 6/2013 | Choi | G09G 3/3696 345/691 |
| 2014/0184485 | A1* | 7/2014 | Kim | G09G 3/3406 345/102 |
| 2015/0310809 | A1* | 10/2015 | Ryu | G09G 3/342 345/691 |
| 2016/0035297 | A1* | 2/2016 | Oh | G09G 3/3618 345/212 |
| 2016/0358561 | A1* | 12/2016 | Chen | G09G 3/36 |
| 2017/0069256 | A1* | 3/2017 | Seo | G09G 3/3648 |
| 2017/0110066 | A1* | 4/2017 | Luo | G09G 3/3406 |

FOREIGN PATENT DOCUMENTS

| | | | |
|---|---|---|---|
| CN | 103093727 | A | 5/2013 |
| CN | 103137087 | A | 6/2013 |
| CN | 104299578 | A | 1/2015 |
| CN | 105489171 | A | 4/2016 |
| CN | 106097982 | A | 11/2016 |
| CN | 106652919 | A | 5/2017 |
| CN | 107195275 | A | 9/2017 |
| JP | 2013088526 | A | 5/2013 |

OTHER PUBLICATIONS

Office Action from Chinese Application No. 201710623557.4 dated Oct. 15, 2018 (5 pages).

Extended European Search Report from European Application No. 18839023.1 dated May 12, 2020 (9 pages).

* cited by examiner

METHOD OF DRIVING DYNAMIC BACKLIGHT AND DISPLAY DEVICE

CROSS-REFERENCE TO RELATED APPLICATION

This application claims the benefit and priority of Chinese Patent Application No. 201710623557.4, filed Jul. 27, 2017. The entire disclosure of the above application is incorporated herein by reference

FIELD

The present disclosure relates to the field of display technologies and particularly to a method of driving a dynamic backlight and a display device.

BACKGROUND

This section provides background information related to the present disclosure which is not necessarily prior art.

With the development of the television technologies, the televisions using the multiple-subarea dynamic backlight technology become the flagship products of all the big television brands rapidly. In such type of television, the backlight is divided into multiple independent subareas, and the backlight of each subarea can be adjusted according to the bright and dark of the pictures in real time, so that the contrast of the bright and dark of the displayed pictures is obvious, and the pictures are clearer and brighter.

BRIEF SUMMARY

This section provides a general summary of the disclosure, and is not a comprehensive disclosure of its full scope or all of its features.

According to a first aspect of some embodiments of the disclosure, a method of driving a dynamic backlight is provided, which includes:

receiving a vertical synchronization signal corresponding to an input image signal;

outputting a first level signal of a first time length to a drive chip in response to a change edge of the vertical synchronization signal;

alternately outputting a second level signal of a second time length and the first level signal of the first time length to the drive chip after generating the first level signal in response to the change edge and before detecting a first change edge after the change edge in the vertical synchronization signal, wherein a signal frequency of a signal constituted by the first level signal and the second level signal outputted alternately is m times of a frequency constituted by the change edge and a first change edge before the change edge in the vertical synchronization signal, wherein the change edge and the first change edge before the change edge are change edges of a same changing direction; m is a positive integer;

receiving, by the drive chip, the first level signal and the second level signal, and generating a PWM signal according to the first level signal and the second level signal.

According to a second aspect of some embodiments of the disclosure, another method of driving a dynamic backlight is provided, which includes:

receiving a vertical synchronization signal corresponding to an input image signal;

alternately outputting a first level signal and a second level signal in response to a change edge of the vertical synchronization signal, wherein the total duration of the first level signal and the second level signal is 1/m of the duration between the change edge and a first change edge before the change edge, wherein the change edge and the first change edge before the change edge are change edges of a same changing direction; m is a positive integer;

receiving, by the drive chip, the first level signal and the second level signal, and generating a PWM signal according to the first level signal and the second level signal.

According to a third aspect of some embodiments of the disclosure, a method of driving a dynamic backlight is provided, which includes:

obtaining a vertical synchronization signal meeting a processor output standard;

generating a first level signal with a time length of nT1 when detecting a change edge of the vertical synchronization signal, and generating a second level signal in a period of time from an ending of the first level signal to a next detection of a change edge, wherein T1 is a cycle of a target signal, and n is determined by a multiple relation between cycles of the vertical synchronization signal and the target signal;

transmitting the first level signal and the second level signal to a drive chip, so that the drive chip generates a PWM signal according to the first level signal and the second level signal.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limited the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION OF THE EMBODIMENTS

Example embodiments will now be described more fully with reference to the accompanying drawings.

In the related art, when the television using the multiple-subarea dynamic backlight technology displays pictures, the multiple frequency processor obtains the vertical synchronization signal (i.e., Vsync signal) transmitted by the scan chip and processes it accordingly, and then transmits the vertical synchronization signal generated after processing and outputted by the multiple frequency processor to the drive chip; and after receiving the vertical synchronization signal outputted by the multiple frequency processor, the drive chip generates a corresponding PWM (Pulse Width Modulation) signal according to the vertical synchronization signal outputted by the multiple frequency processor, and drives the display screen to perform the corresponding backlight display according to the PWM signal, to thereby implement the display of the television.

However, it is found in the research process of the disclosure that, in the displaying process of a television using dynamic backlight control with or without multiple-subarea, there is a need to switch between different frame frequency standard with different frame frequency at times, and thus in the switching process, there may be an interference signal with a large frequency mixed in the vertical synchronization signal outputted by the multiple frequency processor. In this case, the duty cycle saltation area will exist in the PWM signal generated by the driver after receiving the vertical synchronization signal with the interference signal outputted by the multiple frequency processor, so that the phenomenon of backlight flicker occurs in the television.

Figure 1:
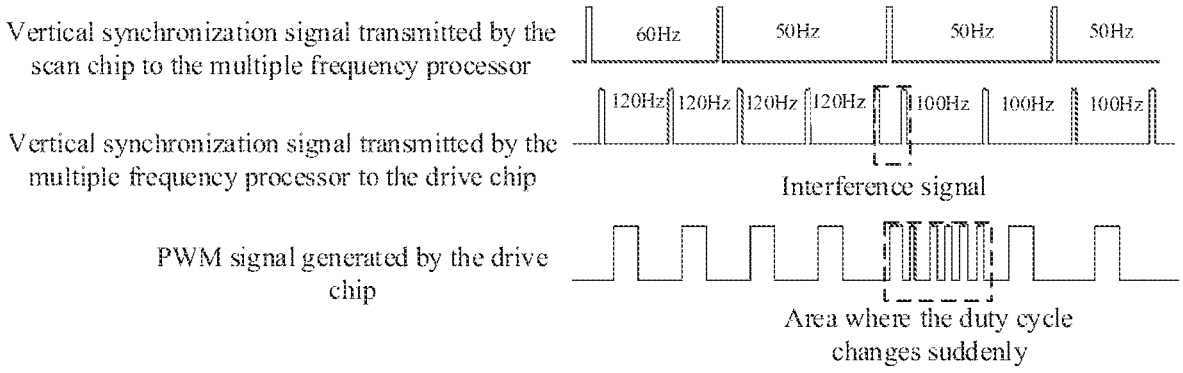
FIG. 1 is a schematic diagram of a signal time sequence in the related art.

In the research process, the following situation is found for example by referring to the waveform schematic diagram in the signal time sequence diagram as shown in FIG. 1. In this figure, the first waveform is the waveform of the first vertical synchronization signal outputted by the scan chip to the multiple frequency processor, wherein the frequency of this signal is 50/60 Hz, showing the conversion process from 60 Hz to 50 Hz; the second waveform is the waveform of the second vertical synchronization signal outputted by the multiple frequency processor to the PWM drive chip after the frequency multiplication processing, and this waveform is transmitted by the multiple frequency processor to the drive chip (PWM drive chip), wherein the frequency of the second vertical synchronization signal after the frequency multiplication processing is generally above 100/120 Hz. Furthermore, the multiple frequency processor generates the second vertical synchronization signal under the triggering of the first vertical synchronization signal. In some embodiments of the related technology, the multiple frequency processor may output the pulse of the second vertical synchronization signal in the preset time period after receiving the rising edge or falling edge of the first vertical synchronization signal, so the frame frequency standard switching is performed in the television displaying process so that the interference signal with a large frequency exists between the signals of 100 Hz and 120 Hz. FIG. 1 shows the conversion process from 120 Hz to 100 Hz; and this makes the cycle between the last pulse of 120 Hz signal and the first pulse of 100 Hz signal is reduced greatly and the corresponding frequency is relatively high. The third waveform is the waveform of the PWM signal generated by the drive chip, and the PWM signal corresponding to the time period between the last pulse of 120 Hz signal and the first pulse of 100 Hz signal has the frequency corresponding to the cycle between the last pulse of 120 Hz signal and the first pulse of 100 Hz signal, which forms the duty cycle saltation area. In this case, the PWM signal in the sudden change area will cause the backlight flicker on the display screen.

The embodiments of the disclosure will be described below in combination with the figures.

Some embodiments of the disclosure discloses a method of driving a dynamic backlight so as to solve the problem in the related art that the backlight flicker occurs on the television in the displaying process.

The first embodiment of the disclosure discloses a method of driving a dynamic backlight, where this method is generally applied to the multiple frequency processor arranged in the television which uses the multiple-subarea dynamic backlight technology. The multiple frequency processor is connected to the scan chip and the drive chip installed in the television. Here, the multiple frequency processor is generally an MCU (Microcontroller Unit), and of course, the multiple frequency processor can be another device, which is not limited by the embodiments of the disclosure.

Figure 2:
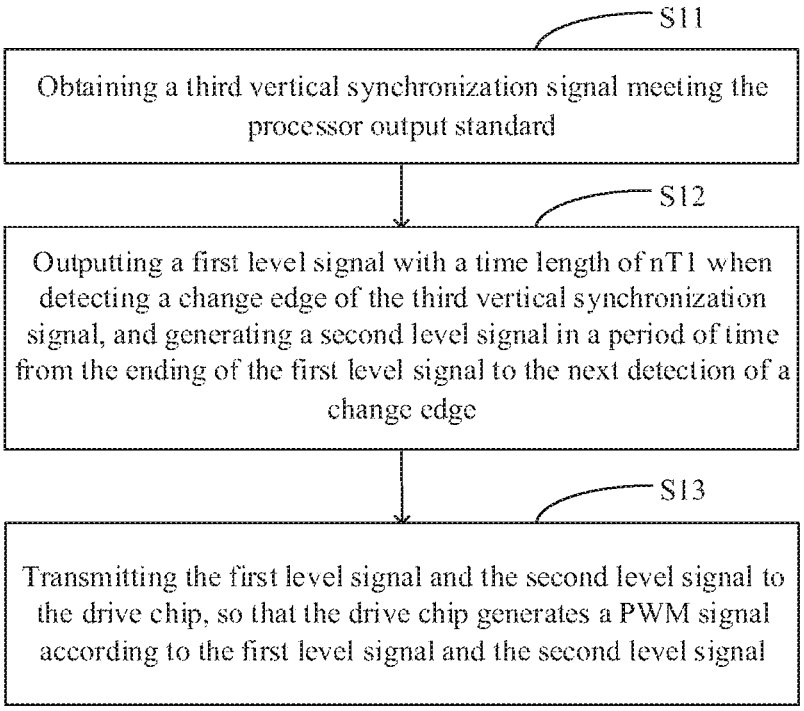
FIG. 2 is a schematic diagram of a workflow of a method of driving a dynamic backlight disclosed by some embodiments of the disclosure.

Referring to the schematic diagram of the workflow as shown in FIG. 2, the method of driving the dynamic backlight disclosed by the embodiment of the disclosure includes following steps.

Step S11: obtaining a third vertical synchronization signal meeting the output standard of the multiple frequency processor.

The scan chip connected to the multiple frequency processor will transmit a first vertical synchronization signal to the multiple frequency processor, and the multiple frequency processor obtains the third vertical synchronization signal meeting the output standard of the multiple frequency processor according to the first vertical synchronization signal.

Here, in the television using the multiple-subarea dynamic backlight technology, the frequency of the vertical synchronization signal meeting the output standard of the multiple frequency processor is generally at or above 100/120 Hz.

In some embodiments of the disclosure, the scan chip can be a SoC (System on Chip), which is used to obtain the first vertical synchronization signal according to the input image and transmit the first vertical synchronization signal to the multiple frequency processor. Of course, the scan chip can also be another type of chip, which is not limited by the embodiments of the disclosure.

Step S12: outputting a first level signal with a time length of nT1 when detecting a change edge of the third vertical synchronization signal, and generating a second level signal in a period of time from the ending of the first level signal to the next detection of a change edge, wherein T1 is the cycle of a target signal, and n is determined by the multiple relation between the cycles of the third vertical synchronization signal and the target signal.

The multiple frequency processor can obtain the first vertical synchronization signal by the scan chip, and the multiple frequency processor can further obtain other types of signals. In this case, the target signal can be selected from the other types of signals, where there is a fixed multiple relation between the cycle of the target signal and the cycle of the third vertical synchronization signal meeting the output standard of the multiple frequency processor.

In this step, the cycle of the third vertical synchronization signal meeting the output standard of the multiple frequency processor is set to n times of the cycle of the target signal. Furthermore, if the moment of detecting the change edge of the third vertical synchronization signal is set to the first moment, the first level signal is generated in the period of time from the first moment to the second moment, wherein the time length from the first moment to the second moment is nT1. The first level signal is generally the level signal of which the hold time is longer in the second vertical synchronization signal.

In the second vertical synchronization signal outputted by the multiple frequency processor, the signal in the same cycle is constituted by the high level signal and the low level signal, of which the hold times are often different. In some embodiments of the disclosure, generally the level signal with the longer hold time is taken as the first level signal, and the first level signal and the second level signal are different. That is to say, if the hold time of the high level is longer in the second vertical synchronization signal outputted by the multiple frequency processor, the first level signal is the high level signal and accordingly the second level signal is the low level signal; and if the hold time of the low level is longer in the second vertical synchronization signal, the first level signal is the low level signal and accordingly the second level signal is the high level signal.

In some embodiments of this disclosure, a total time length of one first level signal and one second level signal adjacent to the one first level signal is nT1.

Furthermore, in some embodiments of the disclosure, the change edge is a rising edge or a falling edge.

Under the action of the system switching and other seasons, the vertical synchronization signal is mixed with the interference signal at times, where the interference signal generally has a larger frequency and a smaller cycle. In some embodiments of the disclosure, since the cycle of the vertical synchronization signal is set to n times of the cycle of the target signal and T1 is the cycle of the target signal, nT1 should be the cycle of the vertical synchronization signal in the normal state (i.e., in the case that no interference signal occurs in the vertical synchronization signal).

In the expression of some embodiments of the disclosure, it is considered that the time length of the second level has a smaller effect on the signal cycle. In some embodiments, the sum of the time length of a first level and the time length of an adjacent second level is taken as one cycle. The first level signal and the second level signal constitutes the second vertical synchronization signal together.

In the step S12, when the change edge of the third vertical synchronization signal is detected, the timer starts, and the first level signal starts to be generated, where the hold time length of the first level signal is nT1, and the second level signal is generated in the period of time from the second moment to the next detection of the change edge of the third vertical synchronization signal. In this case, the first level signal and the second level signal generate periodically, and the hold time length (i.e., nT1) of the first level signal is the cycle of the third vertical synchronization signal in the normal state, so the cycle of the first level signal and the second level signal is close to the cycle of the third vertical synchronization signal in the normal state, which can avoid the influence of the interference signal. In some embodiments, the third vertical synchronization signal corresponding to the first vertical synchronization signal (60 Hz) before the change is 1/120 seconds, and at this time, the sum of the hold time length of the first level signal and the hold time length of the second level signal is equal or close to 1/120 seconds. The third vertical synchronization signal corresponding to the first vertical synchronization signal (50 Hz) after the change is 1/100 seconds, and at this time, the sum of the hold time length of the first level signal and the hold time length of the second level signal is equal or close to 1/100 seconds.

Step S13: transmitting the first level signal and the second level signal to the drive chip, so that the drive chip generates a PWM signal according to the first level signal and the second level signal.

However, in some embodiments of the disclosure, the first level signal and the second level signal are generated according to the third vertical synchronization signal meeting an output standard of the multiple frequency processor, and the first level signal and the second level signal are transmitted to the drive chip, so that the drive chip generates the corresponding PWM signal according to the first level signal and the second level signal. The cycle of the first level signal and the second level signal is close to the cycle of the third vertical synchronization signal in the normal state, to thereby avoid the influence of the interference signal and reduce the phenomenon of backlight flicker.

Figure 3:
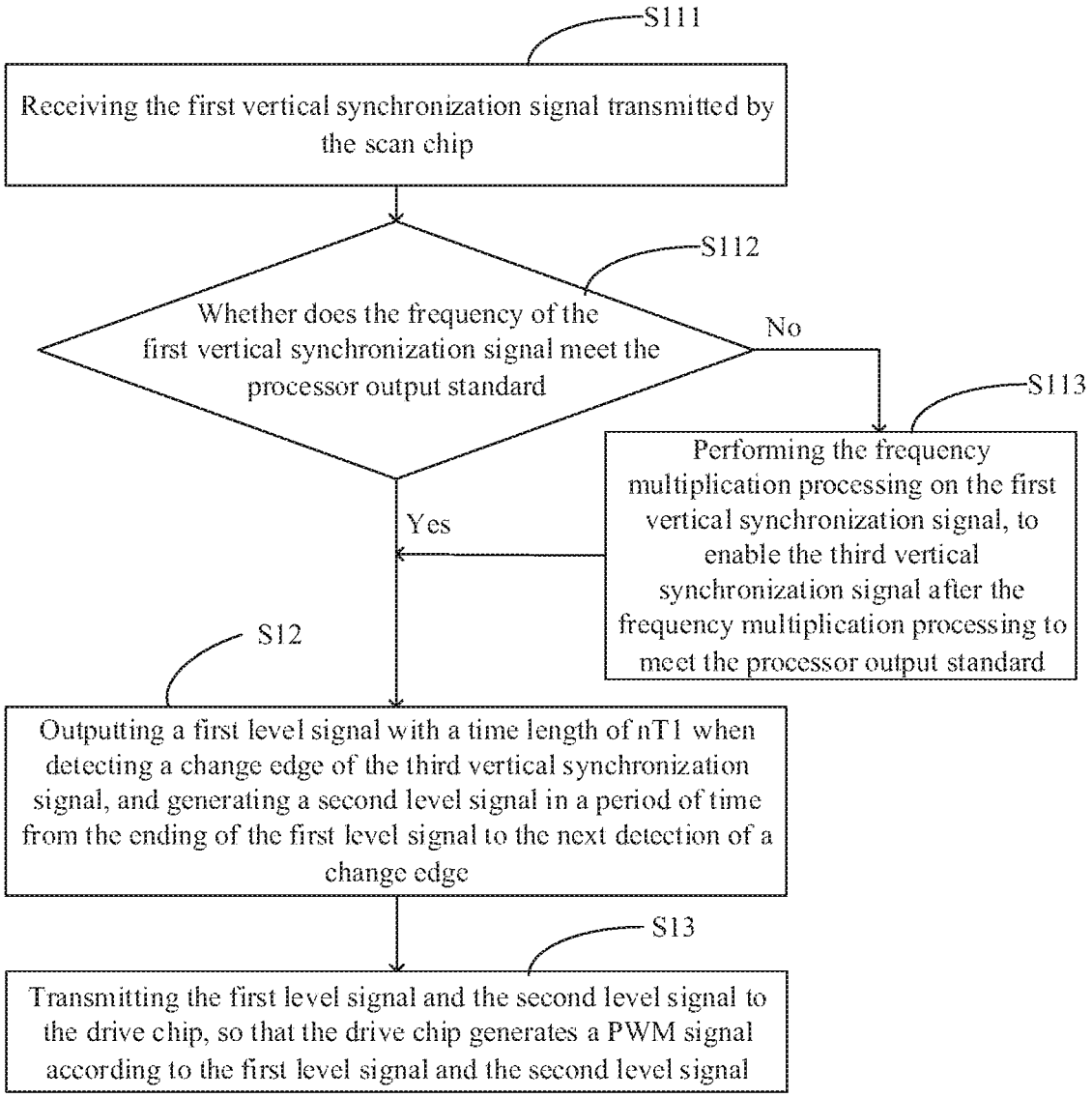
FIG. 3 is a schematic diagram of a workflow of another method of driving a dynamic backlight disclosed by some embodiments of the disclosure.

In the above embodiments, the operation of obtaining the vertical synchronization signal meeting the output standard of the multiple frequency processor is disclosed by the step S11, and referring to the schematic diagram of the workflow as shown in FIG. 3, the operation generally includes following steps.

Step S111: receiving the first vertical synchronization signal transmitted by the scan chip.

Step S112: judging whether the frequency of the first vertical synchronization signal meets the output standard of the multiple frequency processor, if not, performing the operation of step S113, and if so, performing the operation of step S12.

Step S113: if the frequency of the first vertical synchronization signal does not meet the output standard of the multiple frequency processor, performing the frequency multiplication processing on the first vertical synchronization signal, to enable the third vertical synchronization signal generated after the frequency multiplication processing to meet the output standard of the multiple frequency processor, then performing the operation of step S12.

The scan frequency of the scan chip is generally 50/60 Hz, while in the television using the multiple-subarea dynamic backlight technology, the frequency of the vertical synchronization signal outputted by the multiple frequency processor is generally at or above 100/120 Hz, that is to say, the frequency of the vertical synchronization signal meeting the output standard of the multiple frequency processor is generally at or above 100/120 Hz. In this case, after receiving the first vertical synchronization signal transmitted by the scan chip, the multiple frequency processor can determine that the frequency of the first vertical synchronization signal does not meet the output standard of the multiple frequency processor, and thus perform the frequency multiplication processing on it.

Furthermore, if the first vertical synchronization signal transmitted by the scan chip to the multiple frequency processor meets the output standard of the multiple frequency processor, there is no need for the multiple frequency processor to perform the frequency multiplication processing, and the first vertical synchronization signal is taken as the third vertical synchronization signal to perform the step S12.

In order to clarify the effects of all the steps in the embodiment of the disclosure, the embodiment of the disclosure will be illustrated below by a specific instance.

Figure 4:
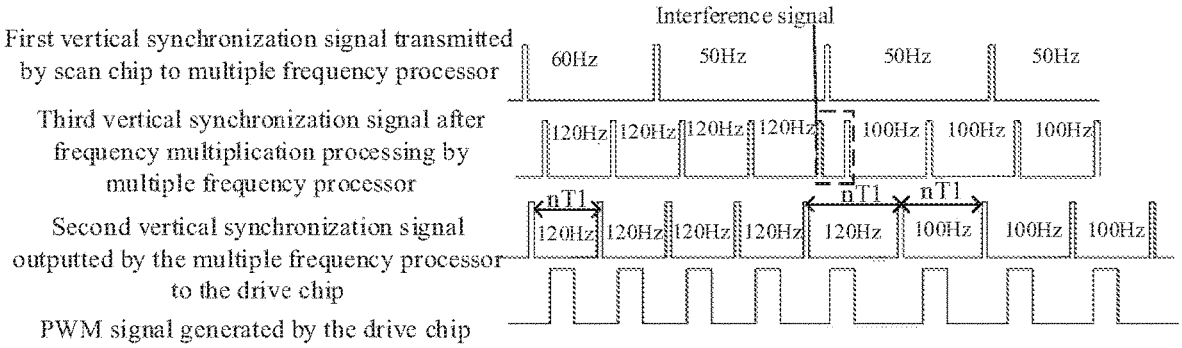
FIG. 4 is a schematic diagram of a signal time sequence in a method of driving a dynamic backlight disclosed by some embodiments of the disclosure.

Referring to FIG. 4, it contains four waveforms. Here, the first waveform is the waveform of the first vertical synchronization signal transmitted by the scan chip to the multiple frequency processor, where the frequency of the first vertical synchronization signal is 50/60 Hz.

After receiving the first vertical synchronization signal, the multiple frequency processor performs the frequency multiplication processing on the first vertical synchronization signal to enable it to meet the output standard of the multiple frequency processor. The third vertical synchronization signal after the frequency multiplication processing (i.e., the vertical synchronization signal meeting the output standard of the multiple frequency processor) is 100/120 Hz, thus forming the second waveform. Furthermore, the interference signal is further included in the second waveform.

As can be seen from the second waveform, the level signal with the longer hold time in the third vertical synchronization signal is the low level signal, then the first level signal is generally selected as the low level signal. Furthermore, the change edge of the third vertical synchronization signal is set to the rising edge of the third vertical synchronization signal in FIG. 4. In this case, after the rising edge of the third vertical synchronization signal is detected, the low level signal (i.e., first level signal) is generated and the hold time of the low level signal is nT 1. Then, the high level signal (i.e., second level signal) is generated in the period of time from the second moment to the next detection of the rising edge of the third vertical synchronization signal, thus forming the third waveform. Here, the third waveform is the waveform of the first level signal and the second level signal, and the third waveform is also the waveform outputted by the multiple frequency processor to the drive chip, i.e., the second vertical synchronization signal.

As can be seen from FIG. 4, there is no waveform of a higher frequency in the third waveform, that is to say, the first level signal and the second level signal are not mixed with the interference signal, to thereby avoid the influence of the interference signal.

In this case, the waveform of the PWM signal generated by the drive chip is as shown by the fourth waveform in FIG. 4, where the duty cycle saltation area does not exist anymore in the fourth line of waveform, to thereby reduce the phenomenon of backlight flicker.

The multiple frequency processor can obtain the first vertical synchronization signal by the scan chip, and the multiple frequency processor can further obtain other various types of signals. In some embodiments of the disclosure, the target signal can be selected from the other types of signals, where there is a fixed multiple relation between the cycle of the target signal and the cycle of the vertical synchronization signal meeting the output standard of the multiple frequency processor.

By analyzing a large amount of experimental data of the control mode of the LED drive chip, it is found that the duty cycle of the backlight PWM will remain stable and there will be no flicker phenomenon if the multiple relation between the second vertical synchronization signal outputted to the drive chip and the horizontal synchronization (Hsync) signal can be remained stably in real time. In an optional embodiment herein, the target signal can be the horizontal synchronization signal (i.e., Hsync signal). In the current smart television, the cycle of the third vertical synchronization signal meeting the output standard of the multiple frequency processor is generally 4096 times of the cycle of the horizontal synchronization signal, in which case the value of n is 4096. Of course, in the smart televisions of different sizes, the multiple relations may be different, and accordingly the value of n will also be changed. Here, the Hsync signal refers to a kind of signal controlling each line of liquid crystal molecules in the display process.

Figure 5:
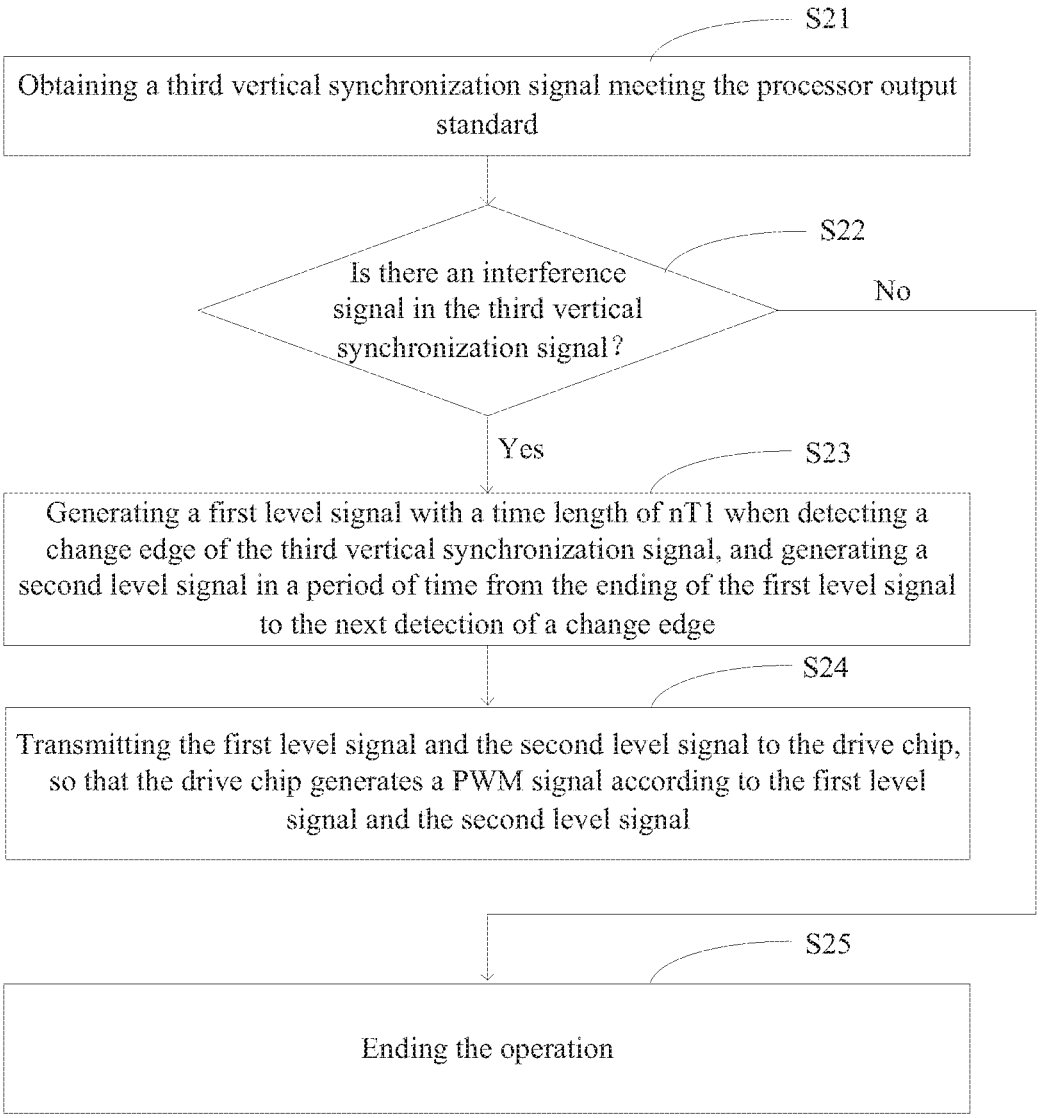
FIG. 5 is a schematic diagram of a workflow of another method of driving a dynamic backlight disclosed by some embodiments of the disclosure.

Another embodiment of the disclosure further discloses a method of driving a dynamic backlight. Referring to the schematic diagram of the workflow as shown in FIG. 5, the method of driving the dynamic backlight includes following steps.

Step S21: obtaining a third vertical synchronization signal meeting the output standard of the multiple frequency processor.

Step S22: detecting whether there is an interference signal in the third vertical synchronization signal after obtaining the third vertical synchronization signal meeting the output standard of the multiple frequency processor, if so, performing the operation of step S23, and if not, performing the operation of step S25.

Step S23: if it is determined that there is the interference signal in the third vertical synchronization signal, generating a first level signal with a time length of nT1 when detecting a change edge of the third vertical synchronization signal, and generating a second level signal in a period of time from the ending of the first level signal to the next detection of a change edge, wherein T1 is the cycle of a target signal, and n is determined by the multiple relation between the cycles of the third vertical synchronization signal and the target signal.

Step S24: transmitting the first level signal and the second level signal to the drive chip, so that the drive chip generates a PWM signal according to the first level signal and the second level signal.

The specific implementation processes of the steps S23 to S24 are the same as the implementation processes of the steps S12 to S13 in the above embodiments, which can refer to each other, and a detailed description thereof will be omitted here.

Step S25: ending the operation.

In some embodiments of the disclosure, after the third vertical synchronization signal meeting the output standard of the multiple frequency processor is obtained, it is detected whether there is the interference signal in the third vertical synchronization signal. If it is determined that there is the interference signal in the third vertical synchronization signal, then the operations of generating the first level signal with the time length of nT1 when detecting the change edge of the third vertical synchronization signal, and generating the second level signal in the period of time from the ending of the first level signal to the next detection of the change edge are performed. In this case, the subsequent operations are performed only when it is determined that there is the interference signal in the third vertical synchronization signal, thus reducing the load of the multiple frequency processor.

Furthermore, the frequency of the interference signal is generally greater than the output standard of the multiple frequency processor. In this case, in some embodiments of the disclosure, if it is detected that there is a signal of a larger frequency in the third vertical synchronization signal, generally it can be determined that the interference signal is detected.

Further, the method of driving the dynamic backlight disclosed by the embodiment of the disclosure further includes following operations.

Generating an initial level signal after obtaining the third vertical synchronization signal meeting the output standard of the multiple frequency processor and before detecting the change edge of the third vertical synchronization signal, wherein the frequency of the initial level signal meets the output standard of the multiple frequency processor.

Transmitting the initial level signal to the drive chip, so that the drive chip generates a corresponding PWM signal according to the initial level signal.

The first level signal and the second level signal have not been generated after obtaining the third vertical synchronization signal and before detecting the change edge of the third vertical synchronization signal. In this case, the multiple frequency processor generates the initial level signal meeting the output standard of the multiple frequency processor. For example, if the output standard of the multiple frequency processor is 100/120 Hz, the frequency of the initial level signal can be 100 Hz or 200 Hz.

Figure 6:
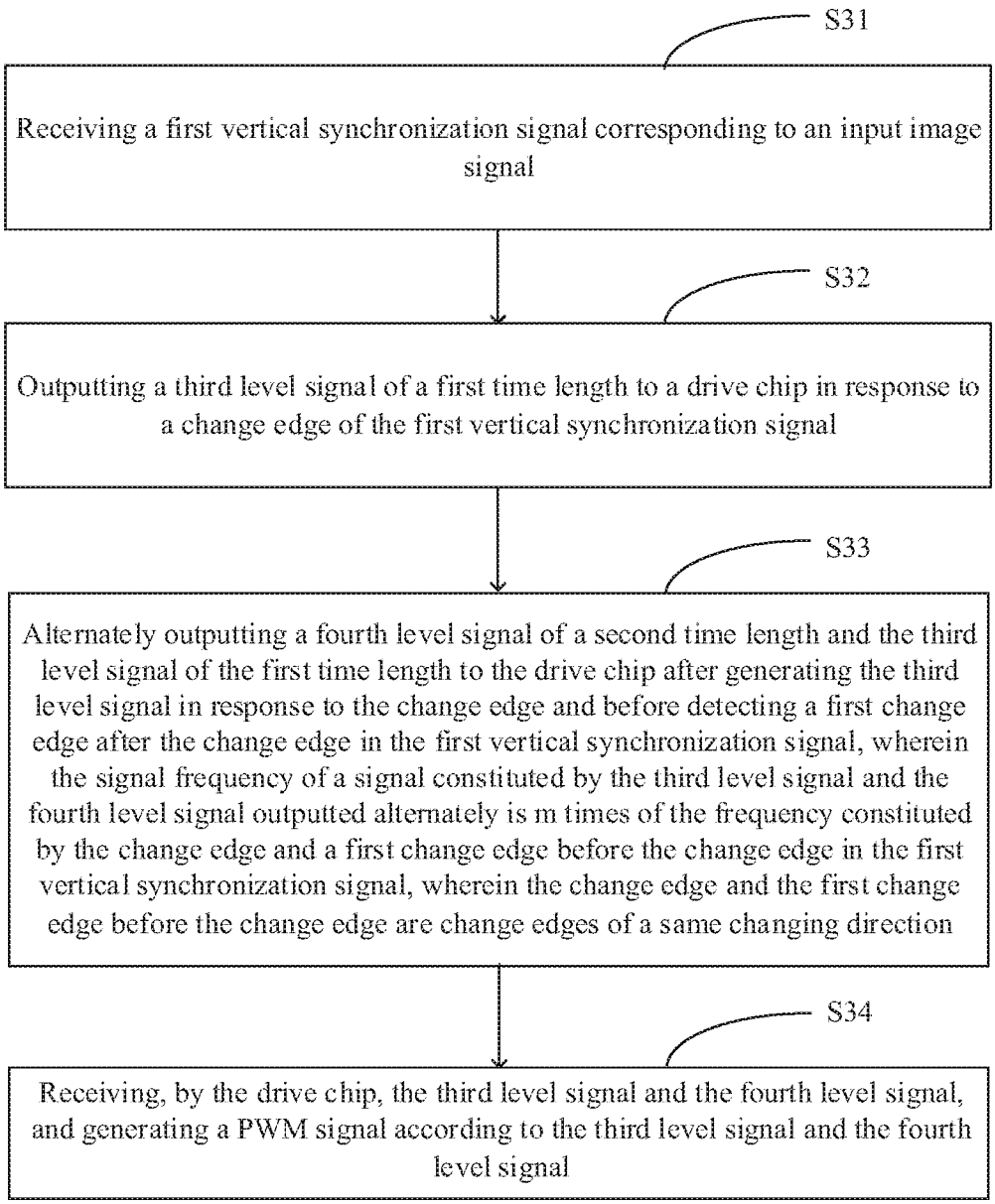
FIG. 6 is a schematic diagram of a workflow of another method of driving a dynamic backlight disclosed by some embodiments of the disclosure.

Some other embodiments of the disclosure provide another method of driving a dynamic backlight. As shown in FIG. 6, the method includes following steps.

Step S31: receiving a first vertical synchronization signal corresponding to an input image signal.

Step S32: outputting a third level signal of a first time length to a drive chip in response to a change edge of the first vertical synchronization signal.

Step S33: alternately outputting a fourth level signal of a second time length and the third level signal of the first time length to the drive chip after generating the third level signal in response to the change edge and before detecting a first change edge after the change edge in the first vertical synchronization signal, wherein the signal frequency of a signal constituted by the third level signal and the fourth level signal outputted alternately is m times of the frequency constituted by the change edge and a first change edge before the change edge in the first vertical synchronization signal, wherein the change edge and the first change edge before the change edge are change edges of a same changing direction; m is a positive integer.

In some embodiments of the disclosure, the steps S32 and S33 can also be replaced by the step of: alternately outputting the third level signal and the fourth level signal in response to the change edge of the first vertical synchronization signal, wherein the total duration of the third level signal and the fourth level signal is 1/m of the duration between the change edge in the first vertical synchronization signal and the first change edge before the change edge, wherein the change edge and the first change edge before the change edge are of a same changing direction change edges; m is a positive integer.

In some embodiments of the disclosure, the third level signal can be the high level signal or can be the low level signal, and is not limited by the occupancy time length.

In some embodiments of the disclosure, the change edge and the first change edge before the change edge are change edges of a same changing direction, which means that the change trend of the change edge is the same as the change trend of the first change edge before the change edge.

Step S34: receiving, by the drive chip, the third level signal and the fourth level signal, and generating a PWM signal according to the third level signal and the fourth level signal.

In some embodiments of the disclosure, generating the PWM signal according to the third level signal and the fourth level signal includes: generating the PWM signal with the frequency which is same as the frequency of the second vertical synchronization signal constituted by the third level signal and the fourth level signal.

In some embodiments of the disclosure, before the first detection of the change edge of the first vertical synchronization signal, the method further includes: outputting an initial level signal to the drive chip; and receiving, by the drive chip, the initial level signal and generating the corresponding PWM signal according to the initial level signal.

In some embodiments of the disclosure, the level of the initial level signal is different from the level of the third level signal. In some embodiments of the disclosure, the level of the initial level signal is low, the level of the third level signal is high, and the level of the fourth level signal is low.

In some embodiments of the disclosure, when detecting a next change edge after the change edge of the first vertical synchronization signal and after the third level signal or the fourth level signal corresponding to this moment is outputted completely, the third level signal of the first time length is outputted in response to the next change edge after the change edge of the first vertical synchronization signal.

Figure 7:
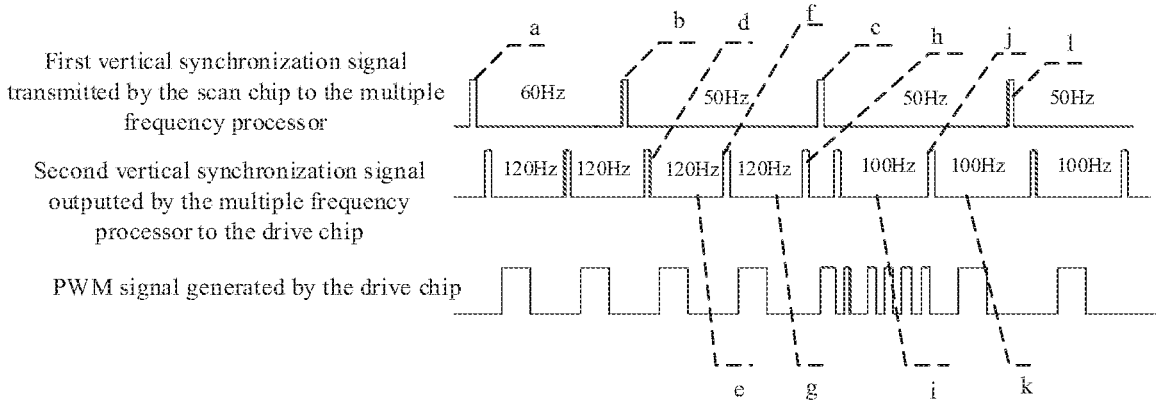
FIG. 7 is a schematic diagram of a signal time sequence in the method of driving the dynamic backlight as shown in FIG. 6.

In order to clarify the effects of all the steps in the embodiment of the disclosure, the embodiment of the disclosure will be illustrated below. Referring to FIG. 7, it contains three waveforms. Here, the first waveform is the waveform of the first vertical synchronization signal (Vsync signal) corresponding to the input image signal. In some embodiments, the frequency of the first vertical synchronization signal is 50/60 Hz.

For example, the third level signal is high and the fourth level signal is low. Before detecting the frequency change of the first vertical synchronization signal, the high level signal b of the first time length is outputted to the drive chip in response to the change edge (which can be the falling edge or rising edge of the pulse b, hereinafter taking rising edge as an example) of the first vertical synchronization signal. After generating the high level signal d in response to the rising edge of the pulse b and before detecting the first change edge (i.e., the rising edge of the pulse c) after the rising edge of the pulse b, the low level e, the high level f and the like are outputted alternately to the drive chip, wherein the low level e, the low level g and the low level i are the low levels with the same hold time length; and the high level d, the high level f and the high level h are the high levels with the same hold time length. The signal frequency of the signal constituted by the high level signal d and the low level e outputted alternately is m times of the frequency constituted by the change edge (i.e., the rising edge of the pulse b) and the first change edge (i.e., the rising edge of the pulse a) before the change edge, wherein the change edge and the first change edge before the change edge are change edges of a same changing direction; m is a positive integer. As shown in FIG. 7, the value of m is 2. Thus the second waveform is formed. Here, the second waveform is the waveform of the third level signal and the fourth level signal, and the second waveform is also the waveform of the second vertical synchronization signal outputted by the multiple frequency processor to the drive chip. After detecting the frequency change of the first vertical synchronization signal, the high level signal j of the first time length is outputted to the drive chip in response to the change edge (which can be the falling edge or rising edge of the pulse c, hereinafter taking rising edge as an example) of the first vertical synchronization signal after the outputting of the low level i of the previous cycle completes in accordance with the corresponding time length. After generating the high level signal j in response to the rising edge of the pulse c and before detecting the first change edge (i.e., the rising edge of the pulse 1) after the rising edge of the pulse c, the low level k and the high level j are outputted alternately to the drive chip, where the signal frequency of the signal constituted by the high level signal j and the low level k outputted alternately is m times of the frequency constituted by the change edge (i.e., the rising edge of the pulse c) and the first change edge (i.e., the rising edge of the pulse b) before the change edge.

As can be seen from FIG. 7, there is no waveform of a higher frequency in the third waveform, that is to say, the third level signal and the fourth level signal are not mixed with the interference signal, to thereby avoid the influence of the interference signal.

In this case, the waveform of the PWM signal generated by the drive chip is as shown by the third waveform in FIG. 7, where the duty cycle saltation area does not exist anymore in the third waveform, to thereby reduce the phenomenon of backlight flicker.

Figure 8:
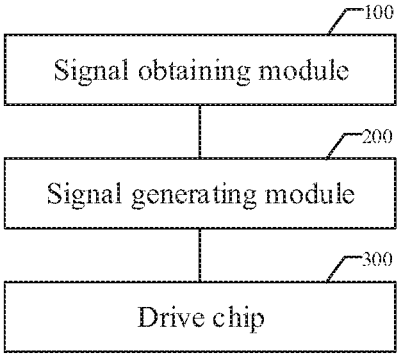
FIG. 8 is a structural schematic diagram of a display device disclosed by some embodiments of the disclosure.

Accordingly, another embodiment of the disclosure further discloses a display device. Referring to the structural schematic diagram as shown in FIG. 8, the display device includes: a signal obtaining module 100, a signal generating module 200 and a drive chip 300. In some embodiments, the signal obtaining module 100 and the signal generating module 200 are both in the multiple frequency processor.

Here, the signal obtaining module 100 is configured to obtain the third vertical synchronization signal meeting the output standard of the multiple frequency processor.

In some embodiments, the signal obtaining module 100 obtain the third vertical synchronization signal meeting the output standard of the multiple frequency processor according to the first vertical synchronization signal.

Here, in the television using the multiple-subarea dynamic backlight technology, the frequency of the vertical synchronization signal meeting the output standard of the multiple frequency processor is generally above 100/120 Hz.

The signal generating module 200 is configured to generate a first level signal with a time length of nT1 when detecting a change edge of the third vertical synchronization signal, and generate a second level signal in a period of time from the ending of the first level signal to the next detection of a change edge, wherein T1 is the cycle of a target signal, and n is determined by the multiple relation between the cycles of the third vertical synchronization signal and the target signal.

The signal obtaining module 100 can obtain the first vertical synchronization signal, and the signal obtaining module 100 can further obtain other types of signals. In this case, the target signal can be selected from the other types of signals, where there is a fixed multiple relation between the cycle of the target signal and the cycle of the third vertical synchronization signal meeting the output standard of the multiple frequency processor.

The signal generating module 200 is further configured to set the cycle of the third vertical synchronization signal meeting the output standard of the multiple frequency processor to n times of the cycle of the target signal. Furthermore, if the moment of detecting the change edge of the third vertical synchronization signal is set to the first moment, the signal generating module 200 generates the first level signal in the period of time from the first moment to the second moment, wherein the time length from the first moment to the second moment is nT1. The first level signal is generally the level signal of which the hold time is longer in the second vertical synchronization signal.

In the second vertical synchronization signal, the signal in the same cycle is constituted by the high level signal and the low level signal, of which the hold times are often different. In some embodiments of the disclosure, generally the level signal with the longer hold time is taken as the first level signal, and the first level signal and the second level signal are different. That is to say, if the hold time of the high level is longer in the second vertical synchronization signal, the first level signal is the high level signal and accordingly the second level signal is the low level signal; and if the hold time of the low level is longer in the second vertical synchronization signal, the first level signal is the low level signal and accordingly the second level signal is the high level signal.

Furthermore, in some embodiments of the disclosure, the change edge is a rising edge or a falling edge.

Under the action of the frame frequency standard switching and other seasons, the third vertical synchronization signal is mixed with the interference signal at times, where the interference signal generally has a larger frequency and a smaller cycle. In some embodiments of the disclosure, since the cycle of the third vertical synchronization signal is set to n times of the cycle of the target signal and T1 is the cycle of the target signal, nT1 should be the cycle of the third vertical synchronization signal in the normal state (i.e., in the case that no interference signal occurs in the vertical synchronization signal).

The drive chip 300 is configured to generate the PWM signal according to the first level signal and the second level signal.

Figure 9:
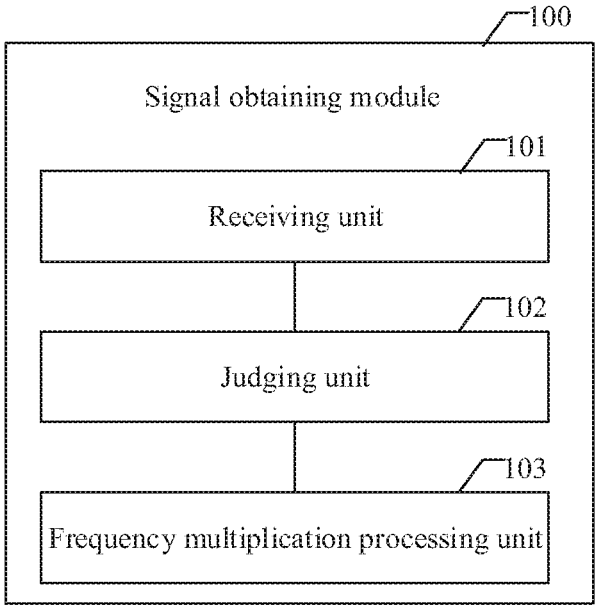
FIG. 9 is a structural schematic diagram of a signal obtaining module in a display device disclosed by some embodiments of the disclosure.

Furthermore, referring to the structural schematic diagram as shown in FIG. 9, the signal obtaining module 100 disclosed by some embodiments of the disclosure includes following units.

A receiving unit 101 configured to receive the first vertical synchronization signal transmitted by the scan chip.

A judging unit 102 configured to judge whether the frequency of the first vertical synchronization signal meets the output standard of the multiple frequency processor.

A frequency multiplication processing unit 103 configured to perform the frequency multiplication processing on the first vertical synchronization signal if the frequency of the first vertical synchronization signal does not meet the output standard of the multiple frequency processor, to enable the third vertical synchronization signal after the frequency multiplication processing to meet the output standard of the multiple frequency processor.

The scan frequency of the scan chip is generally 50/60 Hz, while in the television using the multiple-subarea dynamic backlight technology, the frequency of the third vertical synchronization signal outputted by the multiple frequency processor is generally at or above 100/120 Hz, that is to say, the frequency of the vertical synchronization signal meeting the output standard of the multiple frequency processor is generally at or above 100/120 Hz. In this case, after receiving the first vertical synchronization signal transmitted by the scan chip, the multiple frequency processor can determine that the frequency of the original vertical synchronization signal does not meet the output standard of the multiple frequency processor, and thus perform the frequency multiplication processing on it.

In some embodiments herein, the target signal can be a signal with the frequency which is same as the scanning frequency of the display panel. The target signal can be the horizontal synchronization signal (i.e., Hsync signal). In the current smart television where the drive device is located, the cycle of the vertical synchronization signal meeting the output standard of the multiple frequency processor is generally 4096 times of the cycle of the horizontal synchronization signal, in which case the value of n is 4096. Of course, in the smart televisions of different sizes, the multiple relations may be different, and accordingly the value of n will also change.

Of course, besides the horizontal synchronization signal, the target signal can also be another type of signal, and in this case the value of n needs to be adjusted, which is not limited by the embodiments of the disclosure.

Further, the display device disclosed by the embodiment of the disclosure further includes: an interference detection module.

Here, the interference detection module is configured to detect whether there is an interference signal in the third vertical synchronization signal after obtaining the third vertical synchronization signal meeting the output standard of the multiple frequency processor.

If the interference detection module determines that there is the interference signal in the third vertical synchronization signal, the interference detection module triggers the signal generating module to perform the corresponding operations. That is to say, the interference detection module triggers the signal generating module to perform the operations of generating the first level signal with the time length of nT1 when detecting the change edge of the third vertical synchronization signal, and generating the second level signal in the period of time from the ending of the first level signal to the next detection of the change edge.

Through the display device disclosed by the embodiment of the disclosure, the subsequent operations can be performed only when it is determined that there is the interference signal in the vertical synchronization signal, thus reducing the unnecessary load.

Furthermore, the frequency of the interference signal is generally greater than the output standard of the multiple frequency processor. In this case, if the interference detection module detects that there is a signal of a larger frequency in the vertical synchronization signal, generally it can be determined that the interference signal is detected.

Further, the display device disclosed by the embodiment of the disclosure further includes followings.

An initial signal generating module configured to generate an initial level signal after obtaining the third vertical synchronization signal meeting the output standard of the multiple frequency processor and before detecting the change edge of the third vertical synchronization signal, wherein the frequency of the initial level signal meets the output standard of the multiple frequency processor.

An initial signal transmitting module configured to transmit the initial level signal to the drive chip, so that the drive chip generates a corresponding PWM signal according to the initial level signal.

The first level signal and the second level signal have not been generated after obtaining the third vertical synchronization signal and before detecting the change edge of the third vertical synchronization signal. In this case, the initial level signal meeting the output standard of the multiple frequency processor is generated by the initial signal generating module. For example, if the output standard of the multiple frequency processor is 100/120 Hz, the frequency of the initial level signal can be 100 Hz or 200 Hz.

Accordingly, another embodiment of the disclosure further discloses a display device of a dynamic backlight, which includes: a non-transitory storage storing computer readable programs, at least one multiple frequency processor and a drive chip.

Here, the multiple frequency processor is configured to perform the computer readable programs to implement following operations.

Obtaining a third vertical synchronization signal meeting the output standard of the multiple frequency processor.

Outputting a first level signal with a time length of nT1 when detecting a change edge of the third vertical synchronization signal, and generating a second level signal in a period of time from an ending of the first level signal to a next detection of a change edge, wherein T1 is the cycle of a target signal, and n is determined by the multiple relation between the cycles of the third vertical synchronization signal and the target signal.

The drive chip is configured to generate the PWM signal according to the first level signal and the second level signal.

In some embodiments, the multiple frequency processor performs the computer readable programs to obtain the third vertical synchronization signal meeting the output standard of the multiple frequency processor according to the first vertical synchronization signal.

Here, in the television using the multiple-subarea dynamic backlight technology, the frequency of the vertical synchronization signal meeting the output standard of the multiple frequency processor is generally at or above 100/120 Hz.

The multiple frequency processor can control the scan chip to obtain the original vertical synchronization signal by performing the computer readable programs, and the multiple frequency processor can further obtain other types of signals by performing the computer readable programs. In this case, the target signal can be selected from the other types of signals, where there is a fixed multiple relation between the cycle of the target signal and the cycle of the vertical synchronization signal meeting the output standard of the multiple frequency processor.

The multiple frequency processor is further configured to perform the computer readable programs to set the cycle of the third vertical synchronization signal meeting the output standard of the multiple frequency processor to n times of the cycle of the target signal. Furthermore, if the moment of detecting the change edge of the third vertical synchronization signal is set to the first moment, the multiple frequency processor generates the first level signal in the period of time from the first moment to the second moment, wherein the time length from the first moment to the second moment is nT1. The first level signal is generally the level signal of which the hold time is longer in the vertical synchronization signal.

In the second vertical synchronization signal, the signal in the same cycle is constituted by the high level signal and the low level signal, of which the hold times are often different. In some embodiments of the disclosure, generally the level signal with the longer hold time is taken as the first level signal, and the first level signal and the second level signal are different. That is to say, if the hold time of the high level is longer in the second vertical synchronization signal, the first level signal is the high level signal and accordingly the second level signal is the low level signal; and if the hold time of the low level is longer in the second vertical synchronization signal, the first level signal is the low level signal and accordingly the second level signal is the high level signal.

Furthermore, in some embodiments of the disclosure, the change edge is a rising edge or a falling edge.

Under the action of the frame frequency standard switching and other seasons, the third vertical synchronization signal is mixed with the interference signal at times, where the interference signal generally has a larger frequency and a smaller cycle. In some embodiments of the disclosure, since the cycle of the third vertical synchronization signal is set to n times of the cycle of the target signal and T1 is the cycle of the target signal, nT1 should be the cycle of the third vertical synchronization signal in the normal state (i.e., in the case that no interference signal occurs in the vertical synchronization signal).

Furthermore, the drive device further includes a scan chip. Before obtaining the vertical synchronization signal meeting the output standard of the multiple frequency processor, the multiple frequency processor is further configured to perform the computer readable programs to implement following operations.

Receiving a first vertical synchronization signal transmitted by a scan chip.

Judging whether the frequency of the first vertical synchronization signal meets the output standard of the multiple frequency processor.

If the frequency of the first vertical synchronization signal does not meet the output standard of the multiple frequency processor, performing the frequency multiplication processing on the first vertical synchronization signal, to enable the third vertical synchronization signal generated after the frequency multiplication processing to meet the output standard of the multiple frequency processor.

The scan frequency of the scan chip is generally 50/60 Hz, while in the television using the multiple-subarea dynamic backlight technology, the frequency of the vertical synchronization signal outputted by the multiple frequency processor is generally above 100/120 Hz, that is to say, the frequency of the vertical synchronization signal meeting the output standard of the multiple frequency processor is generally above 100/120 Hz. In this case, after receiving the first vertical synchronization signal transmitted by the scan chip, the multiple frequency processor can determine that the frequency of the first vertical synchronization signal does not meet the output standard of the multiple frequency processor, and thus perform the frequency multiplication processing on it.

In an optional embodiment herein, the target signal can be the horizontal synchronization signal (i.e., Hsync signal). In the current smart television where the drive device is located, the cycle of the vertical synchronization signal meeting the output standard of the multiple frequency processor is generally 4096 times of the cycle of the horizontal synchronization signal, in which case the value of n is 4096. Of course, in the smart televisions of different sizes, the multiple relations may be different, and accordingly the value of n will also change.

Of course, besides the horizontal synchronization signal, the target signal can also be another type of signal, and in this case the value of n needs to be adjusted, which is not limited by the embodiments of the disclosure.

Further, after obtaining the third vertical synchronization signal meeting the output standard of the multiple frequency processor, the multiple frequency processor is further configured to perform the computer readable programs to detect whether there is an interference signal in the third vertical synchronization signal.

If determining that there is the interference signal in the third vertical synchronization signal, the multiple frequency processor performs the operations of generating the first level signal with the time length of nT1 when detecting the change edge of the third vertical synchronization signal, and generating the second level signal in the period of time from the ending of the first level signal to the next detection of the change edge.

Through the drive device disclosed by the embodiment of the disclosure, the subsequent operations can be performed only when it is determined that there is the interference signal in the third vertical synchronization signal, thus reducing the load of the multiple frequency processor.

Furthermore, the frequency of the interference signal is generally greater than the output standard of the multiple frequency processor. In this case, if the interference detection module detects that there is a signal of a larger frequency in the third vertical synchronization signal, generally it can be determined that the interference signal is detected.

Further, in the drive device disclosed by the embodiment of the disclosure, the multiple frequency processor is further configured to perform the computer readable programs to generate an initial level signal after obtaining the third vertical synchronization signal meeting the output standard of the multiple frequency processor and before detecting the change edge of the third vertical synchronization signal, wherein the frequency of the initial level signal meets the output standard of the multiple frequency processor.

The drive chip is further configured to generate the corresponding PWM signal according to the initial level signal.

The first level signal and the second level signal have not been generated after obtaining the third vertical synchronization signal and before detecting the change edge of the third vertical synchronization signal. In this case, the multiple frequency processor performs the computer readable programs to generate the initial level signal meeting the output standard of the multiple frequency processor. For example, if the output standard of the multiple frequency processor is 100/120 Hz, the frequency of the initial level signal can be 100 Hz or 120 Hz.

Accordingly, another embodiment of the disclosure further discloses a display device, which includes: a non-transitory storage storing computer readable programs, a multiple frequency processor and a drive chip, wherein the multiple frequency processor includes a scan chip and a frequency multiplication processing chip.

The scan chip is configured to perform the computer readable programs to implement the operations of: outputting the first vertical synchronization signal corresponding to the input image signal to the frequency multiplication processing chip according to the input image signal.

The frequency multiplication processing chip is configured to perform the computer readable programs to implement the operations of: outputting a third level signal of a first time length to the drive chip in response to a change edge of the first vertical synchronization signal; alternately outputting a fourth level signal of a second time length and the third level signal of the first time length to the drive chip after generating the third level signal in response to the change edge and before detecting a first change edge after the change edge in the first vertical synchronization signal, wherein the signal frequency of the signal constituted by the third level signal and the fourth level signal outputted alternately is m times of the frequency constituted by the change edge and a first change edge before the change edge in the first vertical synchronization signal, wherein the change edge and the first change edge before the change edge are change edges of a same changing direction; m is a positive integer.

The drive chip receives the third level signal and the fourth level signal, and generates a PWM signal according to the third level signal and the fourth level signal.

In some embodiments, generating by the drive chip the PWM signal according to the third level signal and the fourth level signal includes: generating the PWM signal with the frequency which is same as the frequency constituted by the third level signal and the fourth level signal.

In some embodiments, the frequency multiplication processing chip is further configured to perform the computer readable programs to implement following operations.

Outputting an initial level signal to the drive chip before a first detection of the change edge of the first vertical synchronization signal.

Receiving, by the drive chip, the initial level signal, and generating a corresponding PWM signal according to the initial level signal.

In some embodiments, the level of the initial level signal is different from the level of the third level signal. The level of the initial level signal is low, the level of the third level signal is high, and the level of the fourth level signal is low.

In some embodiments, the frequency multiplication processing chip is further configured to perform the computer readable programs to implement following operations.

When detecting a next change edge after the change edge of the first vertical synchronization signal and after the third level signal or the fourth level signal corresponding to this moment is outputted completely, outputting the third level signal of the first time length in response to the next change edge after the change edge of the first vertical synchronization signal.

It can be understood by those skilled in the art that the technologies in the embodiments of the disclosure can be implemented by the way of softwares in combination with the necessary universal hardware platform. Based on such understanding, the technical solution in the embodiments of the disclosure in itself or the part which contributes to the prior art can be embodied in the form of software product. The computer software product can be stored in the storage medium such as ROM/RAM, disk, compact disc or the like, and include a number of instructions used to enable a computer equipment (which can be personal computer, server, network equipment or the like) to perform the methods described in various embodiments or some parts of the embodiments of the disclosure.

The same or similar parts among the various embodiments in the specification can refer to each other. Particularly, for the embodiments of the method of driving the dynamic backlight in the disclosure, the description is relatively simple because they are substantially similar to the method embodiments, and the related parts can refer to the method embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of driving a dynamic backlight, comprising:

obtaining a vertical synchronization signal meeting a processor output standard;

generating a first level signal with a time length of nT1 when detecting a change edge of the vertical synchronization signal, and generating a second level signal in a period of time from an ending of the first level signal to a next detection of a change edge, wherein T1 is a cycle of a target signal, and n is determined by a multiple relation between cycles of the vertical synchronization signal and the target signal; and transmitting the first level signal and the second level signal to a drive chip, so that the drive chip generates a PWM signal according to the first level signal and the second level signal;

wherein obtaining the vertical synchronization signal meeting the processor output standard comprises receiving the vertical synchronization signal transmitted by a scan chip, judging whether a frequency of the vertical synchronization signal transmitted by the scan chip meets the processor output standard, and in response to the frequency of the vertical synchronization signal transmitted by the scan chip not meeting the processor output standard, performing frequency multiplication processing on the vertical synchronization signal transmitted by the scan chip, to enable a vertical synchronization signal generated after the frequency multiplication processing to meet the processor output standard.

2. The method of driving a dynamic backlight according to claim 1, wherein the target signal is a line synchronization signal.

3. The method of driving a dynamic backlight according to claim 1, further comprising:

detecting whether there is an interference signal in the vertical synchronization signal after obtaining the vertical synchronization signal meeting the processor output standard; and in response to detecting the interference signal in the vertical synchronization signal, performing operations of generating the first level signal with the time length of nT1 when detecting the change edge of the vertical synchronization signal, and generating the second level signal in the period of time from the ending of the first level signal to the next detection of the change edge.

4. The method of driving a dynamic backlight according to claim 1, further comprising:

generating an initial level signal after obtaining the vertical synchronization signal meeting the processor output standard and before detecting the change edge of the vertical synchronization signal, wherein a frequency of the initial level signal meets the processor output standard; and transmitting the initial level signal to the drive chip, so that the drive chip generates a corresponding PWM signal according to the initial level signal.

* * * * *